US007681637B2

(12) United States Patent
Frazier et al.

(10) Patent No.: US 7,681,637 B2
(45) Date of Patent: Mar. 23, 2010

(54) SELF-ORIENTING GUIDE SHOE

(76) Inventors: Bradley L Frazier, 5839 Old Seward Hwy., Anchorage, AK (US) 99518-1479; Ronald G Schlappy, 5839 Old Seward Hwy., Anchorage, AK (US) 99518-1479

( * ) Notice: Subject to any disclaimer, the term of this patent is extended or adjusted under 35 U.S.C. 154(b) by 0 days.

(21) Appl. No.: 11/363,128

(22) Filed: Feb. 27, 2006

(65) Prior Publication Data

US 2007/0199694 A1 Aug. 30, 2007

(51) Int. Cl.
*E21B 17/14* (2006.01)

(52) U.S. Cl. ..... 166/242.8; 166/117.7; 166/237

(58) Field of Classification Search ..... 166/242.8, 166/117.7, 237
See application file for complete search history.

(56) References Cited

U.S. PATENT DOCUMENTS 6,158,563 A * 12/2000 Welfonder et al. ..... 192/223.3
6,209,648 B1 * 4/2001 Ohmer et al. ..... 166/313
2005/0006100 A1 * 1/2005 Murray et al. ..... 166/313

OTHER PUBLICATIONS (http://dictionary.reference.com/browse/ratchet).*

* cited by examiner

*Primary Examiner*—David J Bagnell
*Assistant Examiner*—Sean D Andrish
(74) *Attorney, Agent, or Firm*—Michael J. Tavella

(57) ABSTRACT

A guide shoe that utilizes an eccentric nose attached to a cylindrical body that has spiraled, ridged blades extending outward from the body. An orientation system is attached between the body and a hollow shaft. The orientation system is designed to allow free rotation of the body and nose about the shaft during the insertion of the tubing into the hole. It does this by providing clearance between a pawl and notches on the cylindrical body. Indexing of the eccentric nose is provided by a slight retraction of the tubing string in the well hole. Friction between the well hole and ridged blade causes the cylindrical body to rotate about the shaft and lock into an oriented position. The guide shoe is attached to the tubing string by a threaded female connection mating to the matching male connection on the tubing string.

10 Claims, 3 Drawing Sheets

SELF-ORIENTING GUIDE SHOE

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to guide shoes for oil well development and particularly to a self-orienting guide shoe for oil well development 2. Description of the Prior Art The process of drilling for oil is a multi-step process. First, a borehole is drilled into the ground using a drill bit and drill motor attached to the bottom of the drill string. Drilling mud lubricates the borehole and provides the means to power the drill motor. After the borehole has been drilled to a sufficient depth, tubing is inserted into the borehole. Extended reach wells requires a significant axial force to be placed upon the tubing string during the insertion process. Once the tubing reaches final depth, the bore hole and tubing are cleaned and clearance between the tubing and bore hole is provided by pumping high pressure fluid into the tubing string and then out through a guide shoe, which forces debris upward and out of the hole. This is followed by high pressure pumping of cement to secure the tubing into the ground and for zonal isolation. The guide shoe is attached to the bottom of the tubing string and is used to negotiate well bores that have a high degree of deviation, ledges, and depths inherent in extended reach directional drilling. Advanced technology utilized in current guide shoe design includes a rotating eccentric nose that can better negotiate well deviations, and a means of centralization to reduce affects of friction to achieve greater total depth. A problem with the prior art devices is that they do not address the need to overcome friction of the guide shoe and the well bore to orient the eccentric nose to an advantageous position that would enable to the guide shoe to negotiate extreme deviations and ledges in the hole. Rotating guide shoes have the problem of slipping on obstacles, which make progress inefficient, if not impossible. Some guide shoes use reamers to cut through the obstructions without rotating, this is better than simply spinning in place, but can cause difficulties, depending on the material contacted.

BRIEF DESCRIPTION OF THE INVENTION

The instant invention over comes these problems. It is a guide shoe that utilizes an eccentric nose attached to a cylindrical body that has spiraled, ridged blades extending outward from the body. An orientation system is attached between the body and a hollow shaft. The orientation system is designed to allow free rotation of the body and nose about the shaft during the insertion of the tubing into the hole. It does this by providing clearance between a pawl and notches on the cylindrical body. Indexing of the eccentric nose is provided by a slight retraction of the tubing string in the well hole. Friction between the well hole and ridged blade causes the cylindrical body to rotate about the shaft and lock into an oriented position.

The guide shoe is attached to the tubing string by a threaded female connection mating to the matching male connection on the tubing string.

The method for using the self-orienting guide shoe begins with attachment of the guide shoe to the tubing string. Next, the connected tubing is inserted into the borehole. Additional tubing sections are connected in series as needed to reach final depth. The step of inserting the casing into the borehole may include axial force provided by external sources such as the drill rig and or drilling mud. When encountering an obstruction preventing the tubing from further insertion, the tubing string is retracted a small amount causing the eccentric nose of the guide shoe to rotate into the first orientation position. Successive insertions and retractions continue to rotate and thus orient the nose of the shoe until an advantageous position of the eccentric nose vis-à-vis the obstruction is achieved, allowing the tubing to continue the insertion process to the planned final depth.

Thus, there is no need to use reamers to cut though obstructions. Moreover, because the nose locks into a position, it does not rotate freely when it meets an obstruction. The eccentric nose is simply aligned with the obstruction and then pushed forward and past it.

DETAILED DESCRIPTION OF THE INVENTION

Figure 1:
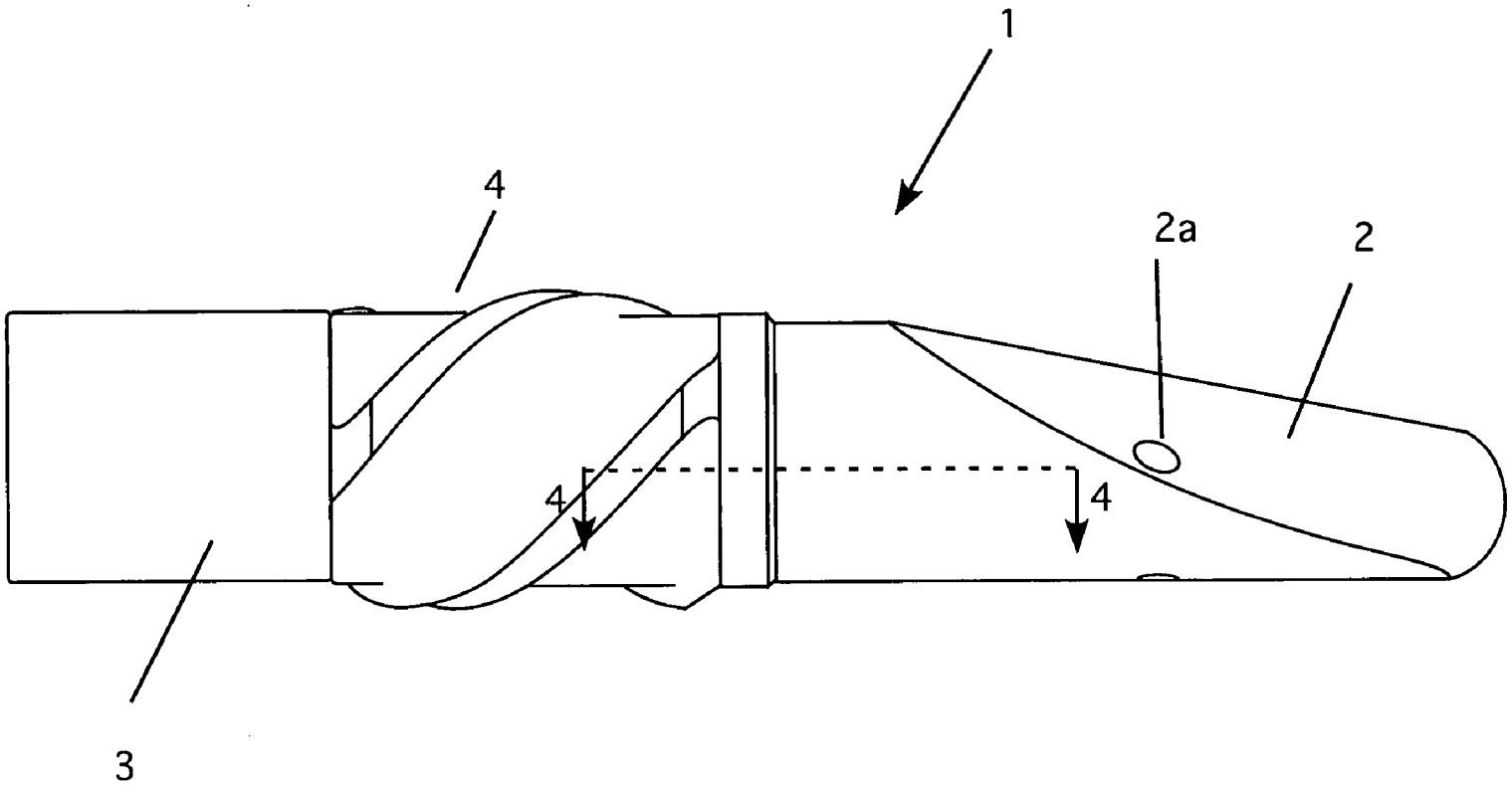
FIG. 1 is a side view of the invention.

Referring now to FIG. 1, the invention is shown in a side view. The guide shoe 1 has an eccentric nose 2 attached to a cylindrical body 3. The cylindrical body 3 has a set of spiraled, ridged blades 4 extending outward from the body as shown. These ridged blades act as a centralizer for the shoe. As with other guide shoes, the nose 2 has an exit port 2*a* for the placement of fluids into the borehole.

Figure 4:
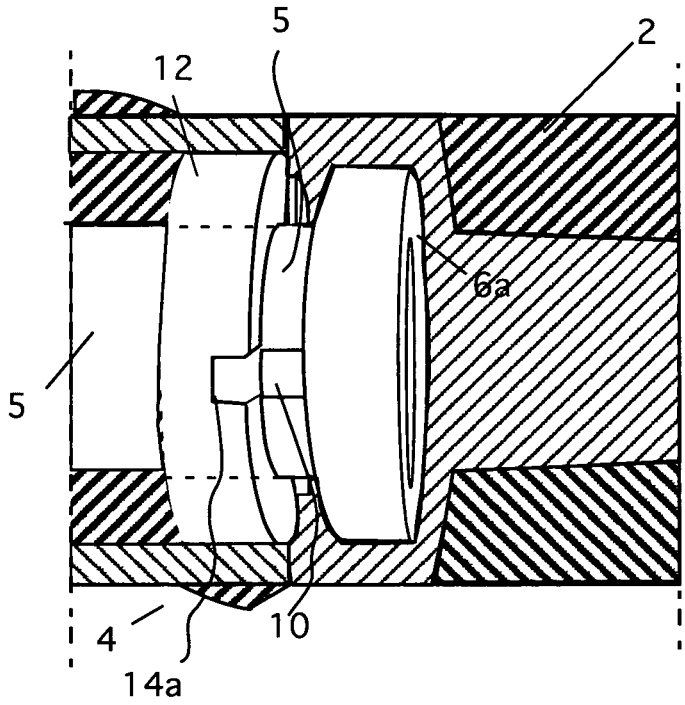
FIG. 4 is a detail view of the internal orienting mechanism shown in the unlocked position taken in a partial cross-section along the dashed lines 4-4 of FIG. 1.

The body 3 is attached to a hollow shaft 5 (see FIG. 4) by the orientation system 6 (see FIG. 4, e.g.). The orientation system is designed to allow free rotation of the body 3 and the nose 2 about the shaft 5 while the tubing is inserted into a hole.

Figure 2:
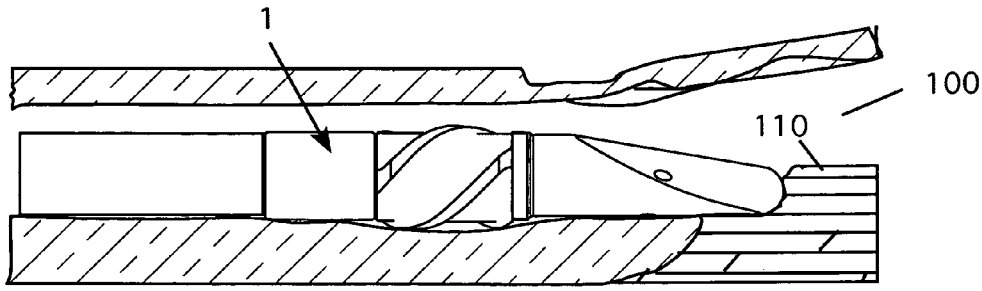
FIG. 2 is a detail side view of a well bore hole showing the invention encountering an obstacle.

FIG. 2 is a detail side view of a well borehole showing the invention encountering an obstacle. As discussed above, the orientation system (discussed in detail below) is used to reorient the nose 2 of the device when it encounters obstacles in its path. In this figure, the guide shoe 1 is in a well borehole 100 has reached an obstacle 110. When this happens, the guide shoe can be backed off, and rotated to a new position in which the eccentric nose can work around the obstacle.

Figure 3:
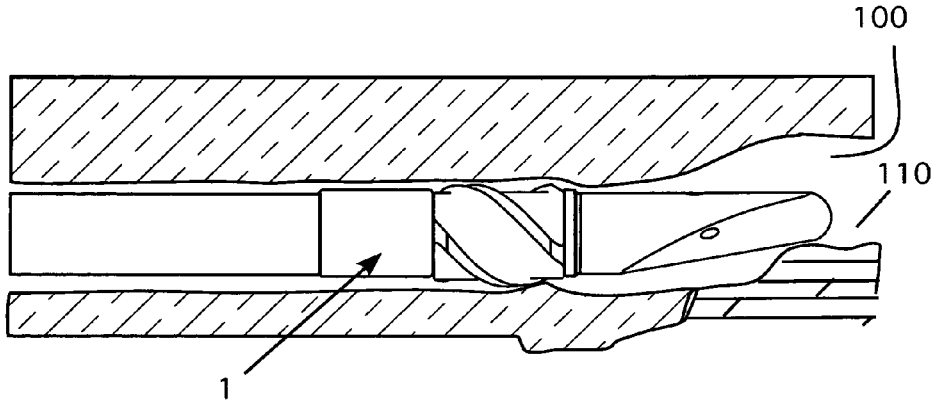
FIG. 3 is a detail side view of a well bore hole showing the invention after it has been rotated and locked to avoid the obstacle.

FIG. 3 is a detail side view of a well bore hole showing the invention after it has been rotated and locked to avoid the obstacle. In this figure, the eccentric nose 2 is now in position to avoid the obstacle 110 and proceed further into the borehole 100.

Figure 5:
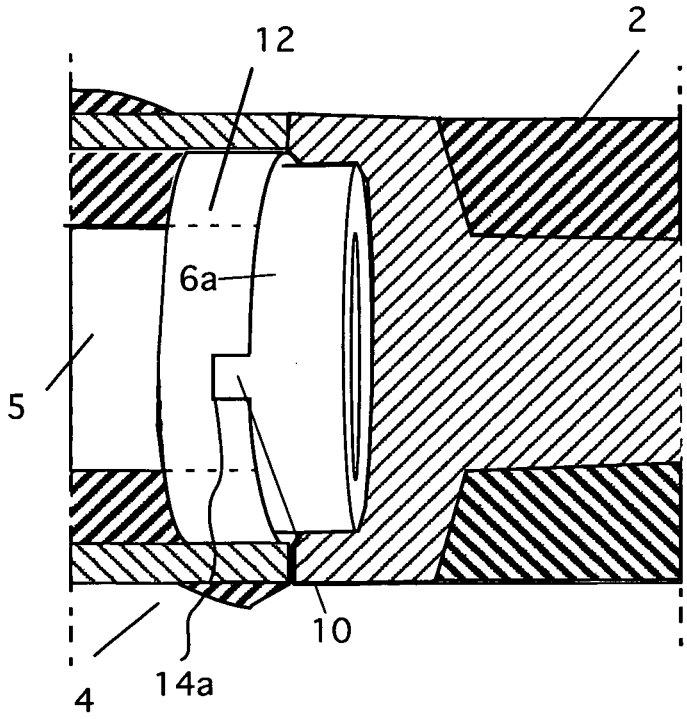
FIG. 5 is a detail view of the internal orienting mechanism shown in the locked position taken in a partial cross-section along the dashed lines 4-4 of FIG. 1.

FIGS. 4 and 5 are side cut-away views showing the internal components of the device. The shaft 5 has the orienting mechanism installed around it as shown.

The orienting mechanism 6 has a ratchet and pawl mechanism 6*a* (discussed further below). The mechanism is designed to lock the shaft 5 in place when the pawl is properly set. When the pawl is released, the shaft 5, and body 3 are free to rotate.

Indexing of the eccentric nose 2 is provided by a slight retraction of the tubing string 101 in the well hole 100. The tubing string runs back to the wellhead and the drilling rig (not shown). Friction between the well hole 100 and ridged blades 4 causes the cylindrical body 3 to rotate about the shaft 5 until the pawl reaches the next slot, where it locks into an oriented position (e.g., that shown in FIG. 5). Note that the orientation of FIG. 3 shows the nose 2 in position to move forward. However, it may take repeated attempts to reorient the nose 2 before the tubing is in position to advance. Once the tool is in the proper position, however, the locking mechanism prevents further rotation, which could cause the nose to be stopped by the obstacle again. As the tubing progresses down the hole, further obstructions are handled in the same way, by the slight retraction of the tool, which unlocks the mechanism 6, rotating the nose to a new position and testing the new position by resuming forward motion. This process is repeated as needed.

Attachment of the guide shoe 1 to the tubing string (not shown) is provided by a threaded female connection 7 (with threads 7*a*) mating to a matching male connection on the tubing string.

FIGS. 4 and 5 are detail views of the internal orienting mechanism shown in the unlocked and locked position. In these views, the mechanism 6 is shown in its full form. FIG. 4 shows the shoe 2 and outer rigid blades 4 and the mechanism is shown in the retracted position (unlocked). The first cylinder 6*a* and pawl 10 are attached to the shaft 5 and are not free to rotate as discussed above. The second cylinder 12 remains fixed within the body 3 and is free to rotate about shaft 5. As the body 3 and shoe turn, they also try to force the body forward (because of the ridged blades 4). As the body moves forward, the pawls 10 come to the next machined slot (e.g., 14 or 14*a* on cylinder 12). At that point, the pawl 10 engages one of the slots 14 or 14*a*, for example, and the cylinders lock together as shown in FIG. 5. At that point, the guide shoe can be moved forward to determine if the nose is able to bypass the obstacle.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

We claim:

1. A guide shoe for well boreholes comprising:

a) a cylindrical body;

b) an eccentric nose, rotatably attached to said cylindrical body and extending forwardly therefrom;

c) an orientation mechanism, attached between said body and said eccentric nose, said orientation mechanism having:

i) a first cylinder, said first cylinder having an open center, an outer circumference, and a hollow shaft fixedly attached to said first cylinder and passing through the open center of said first cylinder, said hollow shaft being positioned in said cylindrical body;

ii) at least one pawl, formed on the outer circumference of said first cylinder; and iii) a second cylinder, said second cylinder having an open center and an outer circumference, said second cylinder being fixedly attached to said cylindrical body and being oppositely disposed from said first cylinder about said hollow shaft, said second cylinder being rotatably positioned about said hollow shaft, said second cylinder having at least two slots formed on the outer circumference of said second cylinder, such that when said pawl and one of said at least two slots are aligned, and said hollow shaft moves in an axial direction with respect to said cylindrical body and said second cylinder, said pawl locks into said one of said at least two slots; and d) a means for threadably attaching said cylindrical body to an end of a length of well tubing.

2. The guide shoe of claim 1 further comprising at least one spiraled, ridged blade extending outward from said cylindrical body.

3. The guide shoe of claim 1 further comprising a plurality of spiraled, ridged blades extending outward from said cylindrical body.

4. The guide shoe of claim 1 wherein the cylindrical body is hollow.

5. The guide shoe of claim 4 wherein the eccentric nose further comprises:

a) an outlet nozzle formed in said eccentric nose; and b) a passageway formed in said eccentric nose and being in fluid communication with said outlet nozzle and said hollow cylindrical body.

6. A guide shoe for well boreholes comprising:

a) a cylindrical body;

b) an eccentric nose, rotatably attached to said cylindrical body and extending forwardly therefrom; and c) a means for orientating said eccentric nose, attached between said body and said eccentric nose, said means for orientating mechanism having:

i) a first cylinder, said first cylinder having an open center, an outer circumference, and a hollow shaft fixedly attached to said first cylinder and passing through the open center of said first cylinder, said hollow shaft being positioned in said cylindrical body;

ii) at least one pawl, formed on the outer circumference of said first cylinder; and iii) a second cylinder, said second cylinder having an open center and an outer circumference, said second cylinder being fixedly attached to said cylindrical body and being oppositely disposed from said first cylinder about said hollow shaft, said second cylinder being rotatably positioned about said hollow shaft, said second cylinder having at least two slots formed on the outer circumference of said second cylinder, such that when said pawl and one of said at least two slots are aligned, and said hollow shaft moves in an axial direction with respect to said cylindrical body and said second cylinder, said pawl locks into said one of said at least two slots; and d) a threaded portion, formed on said cylindrical body, for attaching said guide shoe to a well tubing string.

7. The guide shoe of claim 6 further comprising at least one spiraled, ridged blade extending outward from said cylindrical body.

8. The guide shoe of claim 6 further comprising a plurality of spiraled, ridged blades extending outward from said cylindrical body.

9. The guide shoe of claim 6 wherein the cylindrical body is hollow.

10. The guide shoe of claim 9 wherein the eccentric nose further comprises:

a) an outlet nozzle formed in said eccentric nose; and b) a passageway formed in said eccentric nose and being in fluid communication with said outlet nozzle and said hollow cylindrical body.

* * * * *